US011272801B2

(12) United States Patent
Hanley et al.

(10) Patent No.: US 11,272,801 B2
(45) Date of Patent: Mar. 15, 2022

(54) CURTAIN ROD RETURN BRACKET

(71) Applicant: Kenney Manufacturing Company, Warwick, RI (US)

(72) Inventors: Michael P. Hanley, Warwick, RI (US); Sally Voas, Warwick, RI (US)

(73) Assignee: Kenney Manufacturing Company, Warwick, RI (US)

( * ) Notice: Subject to any disclaimer, the term of this patent is extended or adjusted under 35 U.S.C. 154(b) by 0 days.

(21) Appl. No.: 14/607,446

(22) Filed: Jan. 28, 2015

(65) Prior Publication Data

US 2015/0265086 A1 Sep. 24, 2015

Related U.S. Application Data

(60) Provisional application No. 61/932,544, filed on Jan. 28, 2014.

(51) Int. Cl.

| | |
|---|---|
| ***A47H 1/102*** | (2006.01) |
| ***A47H 1/02*** | (2006.01) |
| ***A47H 1/122*** | (2006.01) |
| ***A47H 1/142*** | (2006.01) |

(52) U.S. Cl.

CPC ..... *A47H 1/102* (2013.01); *A47H 1/02* (2013.01); *A47H 1/122* (2013.01); *A47H 1/142* (2013.01)

(58) Field of Classification Search

CPC . A47H 1/10; A47H 1/102; A47H 1/02; A47H 1/122; A47H 1/142; A47H 1/104; A47H 1/14; A47H 1/144; A47F 1/102; A47F 1/02; A47F 1/122; A47F 1/142

USPC ..... 248/255, 253, 263

See application file for complete search history.

(56) References Cited

U.S. PATENT DOCUMENTS

| | | | | | |
|---|---|---|---|---|---|
| 606,442 | A * | 6/1898 | Bullis | A47H 1/142 | 248/262 |
| 635,991 | A * | 10/1899 | Beitner | A47H 1/142 | 248/263 |
| 1,405,268 | A * | 1/1922 | Brinegar | A47H 1/122 | 248/256 |
| 1,525,533 | A | 2/1925 | Brown | | |
| 1,593,114 | A * | 7/1926 | Wyatt | A47H 1/142 | 248/255 |
| 1,624,392 | A * | 4/1927 | Edwin | A47G 27/065 | 16/14 |
| 2,134,078 | A * | 10/1938 | Farner | A47H 1/13 | 248/255 |
| 2,809,798 | A * | 10/1957 | Kenney | E06B 9/50 | 248/263 |
| 5,678,703 | A * | 10/1997 | Sawyer | A47H 1/02 | 211/105.1 |
| 5,960,516 | A * | 10/1999 | Zoroufy | A47G 27/065 | 16/10 |

(Continued)

*Primary Examiner* — Christopher Garft

(74) *Attorney, Agent, or Firm* — Adler Pollock & Sheehan P.C

(57) ABSTRACT

A curtain rod return bracket is provided and includes a first bracket inner leg, a second bracket inner leg, a bracket outer leg and a bracket mounting portion, wherein the first bracket inner leg and bracket outer leg are associated with the bracket mounting portion such that a first space exists between the bracket inner leg and the bracket outer leg, and wherein the first bracket inner leg and the second bracket inner leg are configured such that a second space exists between the first bracket inner leg and the second bracket inner leg.

12 Claims, 21 Drawing Sheets

(56) References Cited

U.S. PATENT DOCUMENTS 6,206,074 B1 * 3/2001 Liu ..... A47H 99/00 160/349.2
6,338,179 B1 * 1/2002 Blackstone ..... A47G 27/065 16/10
6,830,092 B1 * 12/2004 Hsu ..... A47H 1/18 160/178.1 R
D504,609 S 5/2005 Ferguson
7,080,426 B2 * 7/2006 Roychowdhury ... A47G 27/065 16/10
D539,121 S 3/2007 ter Braak
7,461,431 B2 * 12/2008 Zoroufy ..... A47G 27/065 16/10
D585,268 S 1/2009 Woolley
7,641,060 B2 * 1/2010 Bishop ..... A47H 1/02 211/105.1
D633,780 S 3/2011 Barrese
8,056,873 B1 * 11/2011 Hanley ..... A47H 1/142 248/264
8,359,707 B1 * 1/2013 Prezner ..... A47G 27/065 16/12
8,851,435 B1 * 10/2014 Bastien ..... A47H 1/022 248/251
8,925,148 B2 * 1/2015 Prezner ..... A47H 1/102 16/12
8,925,747 B1 * 1/2015 Hanley ..... A47H 1/022 211/105.6
D739,216 S 9/2015 Cole
D795,680 S 8/2017 Balas
D893,284 S * 8/2020 Hanley ..... A47H 1/02 D8/354
2005/0082451 A1 * 4/2005 Serina ..... E06B 9/42 248/252
2005/0274868 A1 * 12/2005 McCance ..... A47H 1/122 248/674
2007/0170134 A1 * 7/2007 Bishop ..... A47H 1/02 211/105.1
2010/0032536 A1 * 2/2010 Eagan ..... A47H 1/102 248/265
2010/0224749 A1 * 9/2010 Tran ..... A47H 1/142 248/262
2013/0020039 A1 * 1/2013 Claesson ..... A47H 1/02 160/368.1
2013/0233990 A1 * 9/2013 Prezner ..... A47G 27/065 248/262
2014/0103178 A1 * 4/2014 Baines ..... E06B 7/28 248/231.31
2015/0265086 A1 * 9/2015 Hanley ..... A47H 1/102 248/255
2018/0014680 A1 * 1/2018 Hanley ..... F16B 7/1427

* cited by examiner

Section A-A

Section B-B

CURTAIN ROD RETURN BRACKET

RELATED APPLICATIONS

This application is related to and claims benefit of priority of U.S. Provisional Patent Application Ser. No. 61/932,5449, filed Jan. 28, 2014, the contents of which are incorporated by reference herein in its entirety.

FIELD OF THE INVENTION

The present invention relates generally to a curtain rod bracket and more specifically to a curtain rod return bracket having a finial, where the return bracket allows multiple curtains to be used and for the curtain to be positioned to cover the side portions of the window opening.

BACKGROUND OF THE INVENTION

Cylindrical curtain rods are well known and are used for many drapery applications. Generally, the cylindrical shape of the rod helps to make these rods lighter and stronger. Thus, these types of rods are easier to use and work better with heavier curtains/drapes than flat rods.

In one current embodiment, the curtain is associated with the rod via a plurality of clips and curtain rings that loop around and contain the curtain rod and that move along the length of the curtain rod. The cylindrical rods are typically supported on either end (and in some cases, the middle) by a bracket on which the rod rests. When a user wants to cover the window, the curtains are moved along the curtain rod to cover the opening and when a user wants to expose the window, the curtains are moved along the curtain rod to one or both sides to uncover the opening. One advantage of this type of arrangement is that one or both ends of the curtain rod are accessible and thus may contain a finial for decoration. However, if an additional curtain is desired an additional bracket must be used to hold the second curtain in place. This is undesirable because the window trim/moulding and/or wall space surrounding the window may be limited and may not be able to support another bracket. Moreover, the added hardware effects installation time and difficulty and increases cost.

One way this problem has been addressed is to make a bracket that is capable of operably supporting two curtains in a parallel fashion, one in front of the other. One such bracket is shown in U.S. Pat. No. 2,809,798. As can be seen, the bracket requires the rod to have a ferrule with a flat headed stud on either end to mate with a U-shaped bracket to support the rod and the curtain. This is undesirable because 1) the ferrule/stud at each end of the bracket prevents the use of decorative finials with the curtain rod, and 2) the ferrule/stud design does not easily allow a curtain to be extended to cover the bracket and thus cover the side of the window.

SUMMARY OF THE INVENTION

A curtain rod return bracket is provided and includes at least one bracket inner leg, a bracket outer leg and a bracket mounting portion, wherein the bracket inner leg and bracket outer leg are associated with the bracket mounting portion such that a space exists between the bracket inner leg and bracket outer leg.

A curtain rod return bracket is provided and includes a first bracket inner leg, a second bracket inner leg, a bracket outer leg and a bracket mounting portion, wherein the first bracket inner leg and bracket outer leg are associated with the bracket mounting portion such that a first space exists between the bracket inner leg and the bracket outer leg, and wherein the first bracket inner leg and the second bracket inner leg are configured such that a second space exists between the first bracket inner leg and the second bracket inner leg.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike.

DETAILED DESCRIPTION OF THE INVENTION

Figure 1A:
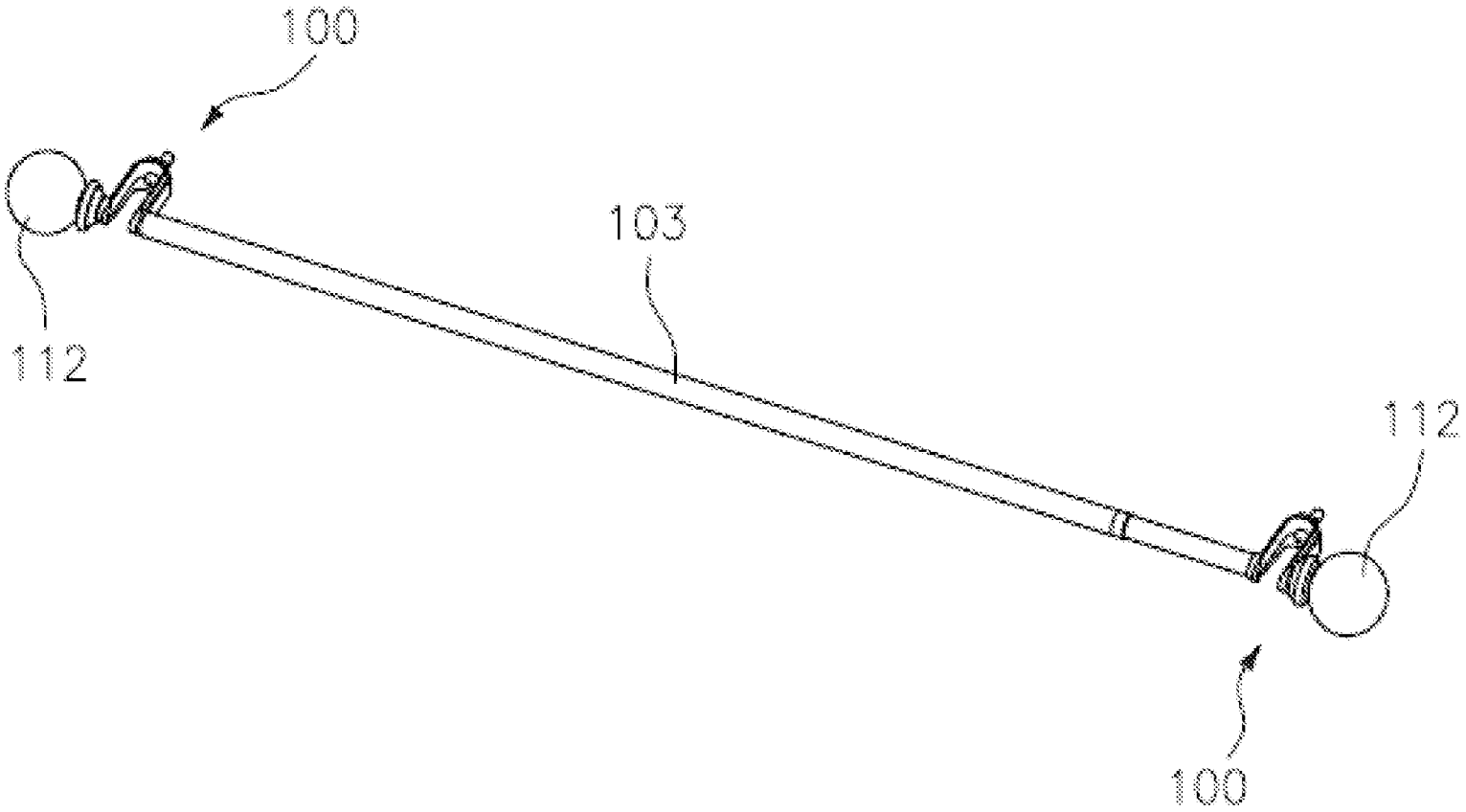
FIG. 1A is a front side isometric view of a curtain rod having a curtain rod return bracket with a decorative finial, in accordance with one embodiment of the invention.
Figure 1B:
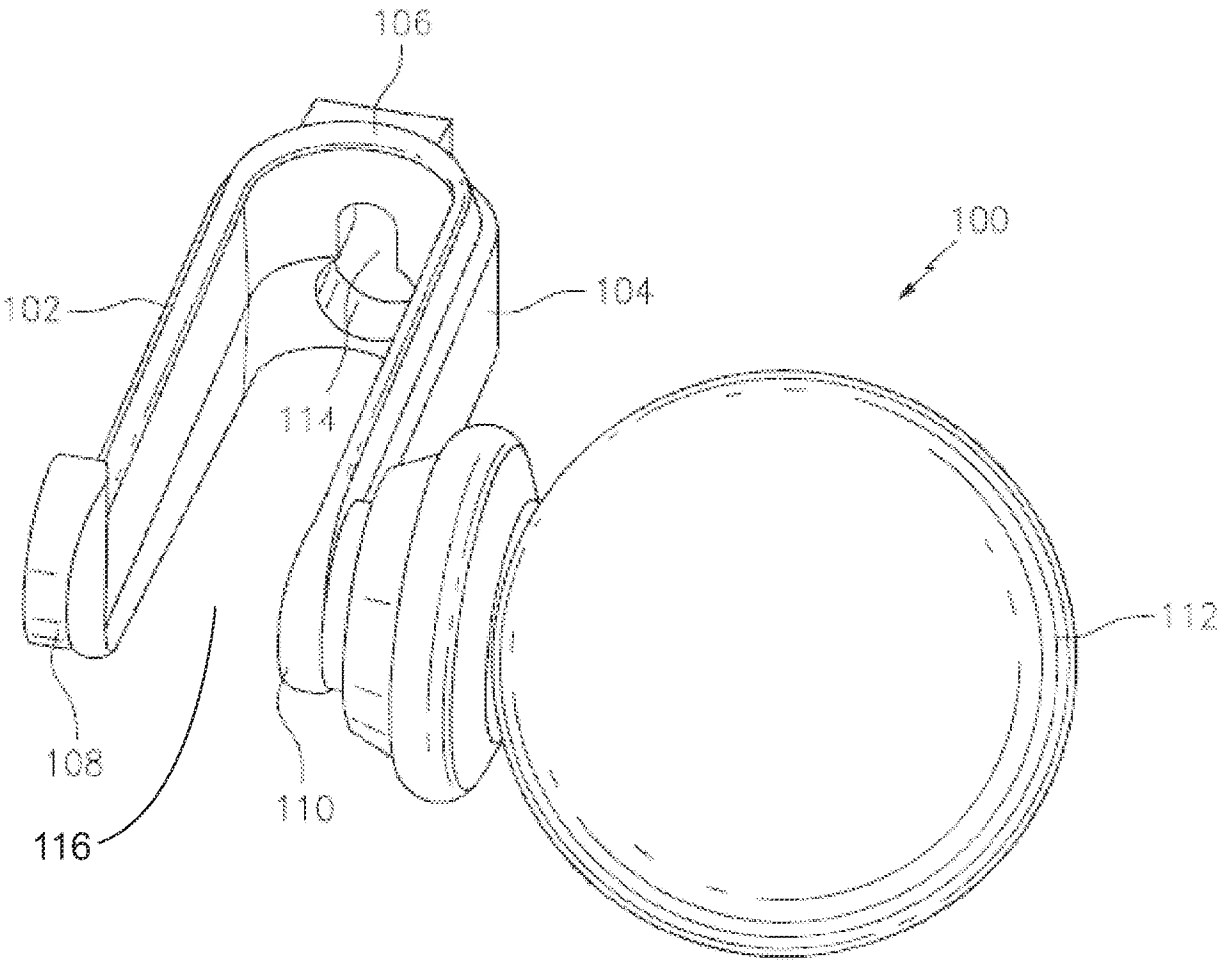
FIG. 1B is a front side perspective view of the curtain rod return bracket having a finial for the curtain rod of FIG. 1A.

Referring to FIG. 1A, FIG. 1B, FIG. 2A, FIG. 2B and FIG. 2C, a curtain return bracket 100 is shown in accordance with a first embodiment of the present invention. The return bracket 100 includes an inner bracket leg 102 and an outer bracket leg 104 connected via a bracket center portion 106. The bracket inner leg 102 includes a rod attachment article 108 configured to securely associate with and support a curtain rod 103. The bracket outer leg 104 includes a finial attachment article 110 configured to securely associate with and support a decorative article, such as a finial 112. It should be appreciated that the inner bracket leg 102 and the outer bracket leg 104 are arranged to be substantially perpendicular to the curtain rod 103. Additionally, the bracket center portion 106 is configured to mount to a wall proximate a window or to the trim/moulding of a window. In this embodiment, the bracket center portion 106 defines a through cavity 114 by which the return bracket 100 can be securely associated with the wall or window trim. It should be appreciated that the curtain rod 103 may be securely associated with the bracket inner leg 102, via any device and/or method suitable to the desired end result, such as a screw/mounting cap configuration, friction fit, clip, etc. It is contemplated that in one embodiment the curtain rod 103 may loosely and/or movably associate with the bracket inner leg 102. Moreover, it should be appreciated that the finial 112 may be securely associated with the bracket outer leg 104, via any device and/or method suitable to the desired end result, such as a screw or friction fit configuration.

Figure 2A:
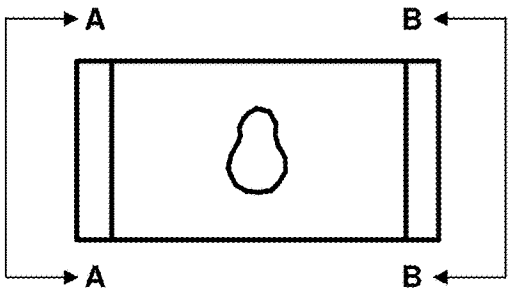
FIG. 2A is a front view of the curtain rod return bracket of FIG. 1.
Figure 2B:
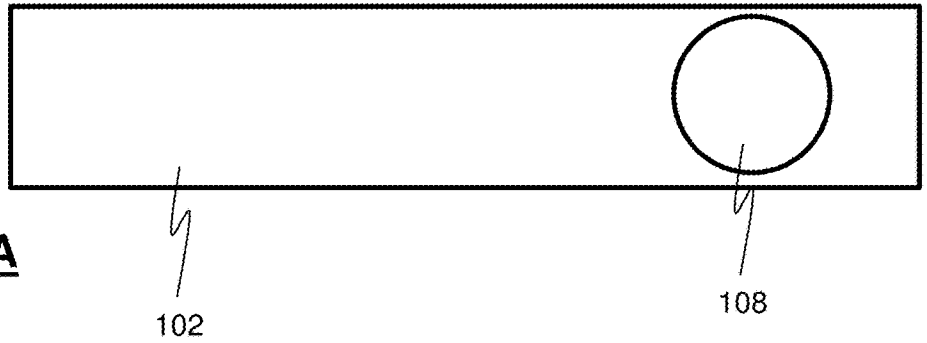
FIG. 2B is a side view of the inner bracket leg of the curtain rod return bracket of FIG. 1.
Figure 2C:
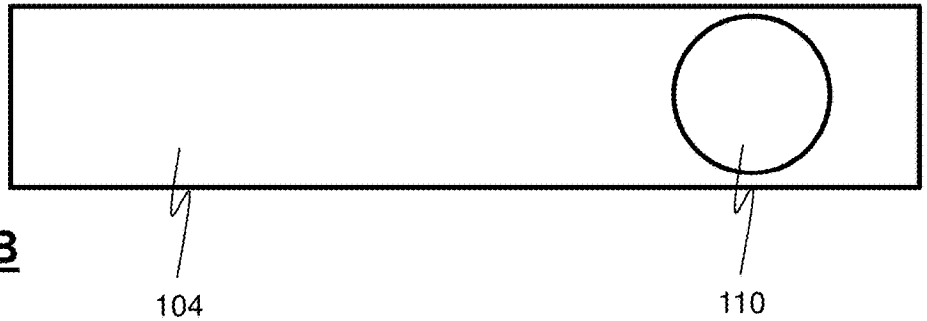
FIG. 2C is a side view of the outer bracket leg of the curtain rod return bracket of FIG. 1.
Figure 2D:
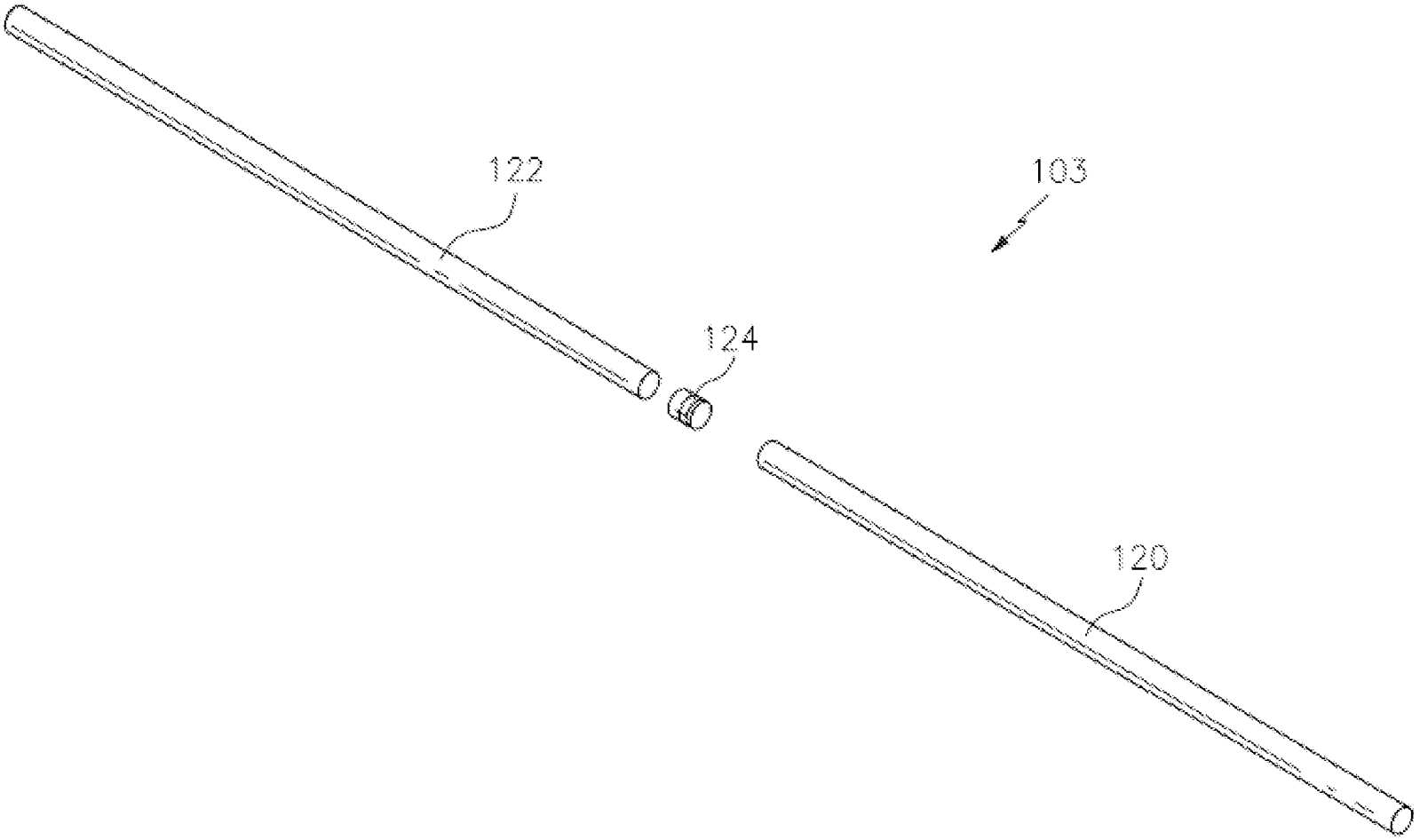
FIG. 2D is a side perspective view of a telescoping curtain rod having an inner rod and an outer rod for use with the curtain rod return bracket of FIG. 1.

It should be appreciated that the curtain rod 103 may be one bar or may be telescoping to be adjustable in length to accommodate different size windows. As such, referring to FIG. 2D, the curtain rod 103 may include an inner rod 120 having an inner rod diameter, an outer rod 122 having an outer rod diameter and a sleeve 124 which acts as an interface between the inner rod 120 and the outer rod 122. The outer rod diameter is larger than the inner rod diameter to allow the inner rod 120 to slide in and out of the outer rod 122 as desired to allow the curtain rod 103 to be adjusted to different lengths. In another embodiment the sleeve 124 may act as a compression fitting to allow the curtain rod 103 to be fixed at a desired length.

Additionally, it should be appreciated that the curtain rod 103 may be associated with the the bracket inner leg 102 via any method and/or device suitable to the desired end purpose. In one embodiment, the curtain rod 103 may include an inner spring between the inner rod 120 and the outer rod 122 to allow the ends of the curtain rod 103 to be compressed against the bracket inner leg 102 of the curtain return bracket 100. Additionally, in another embodiment, the curtain return bracket 100 may include a curtain rod sleeve 130 defining a sleeve cavity 132 for containing the end of the curtain rod 103. Moreover, in still yet another embodiment it is contemplated that the curtain rod 103 may include end caps which may be securely contained within the outer ends of the inner rod 120 and the outer rod 122, wherein the end caps define threaded opening to allow the curtain rod 103 to be securely associated with the bracket inner leg 102 via a threaded screw.

Figure 3:
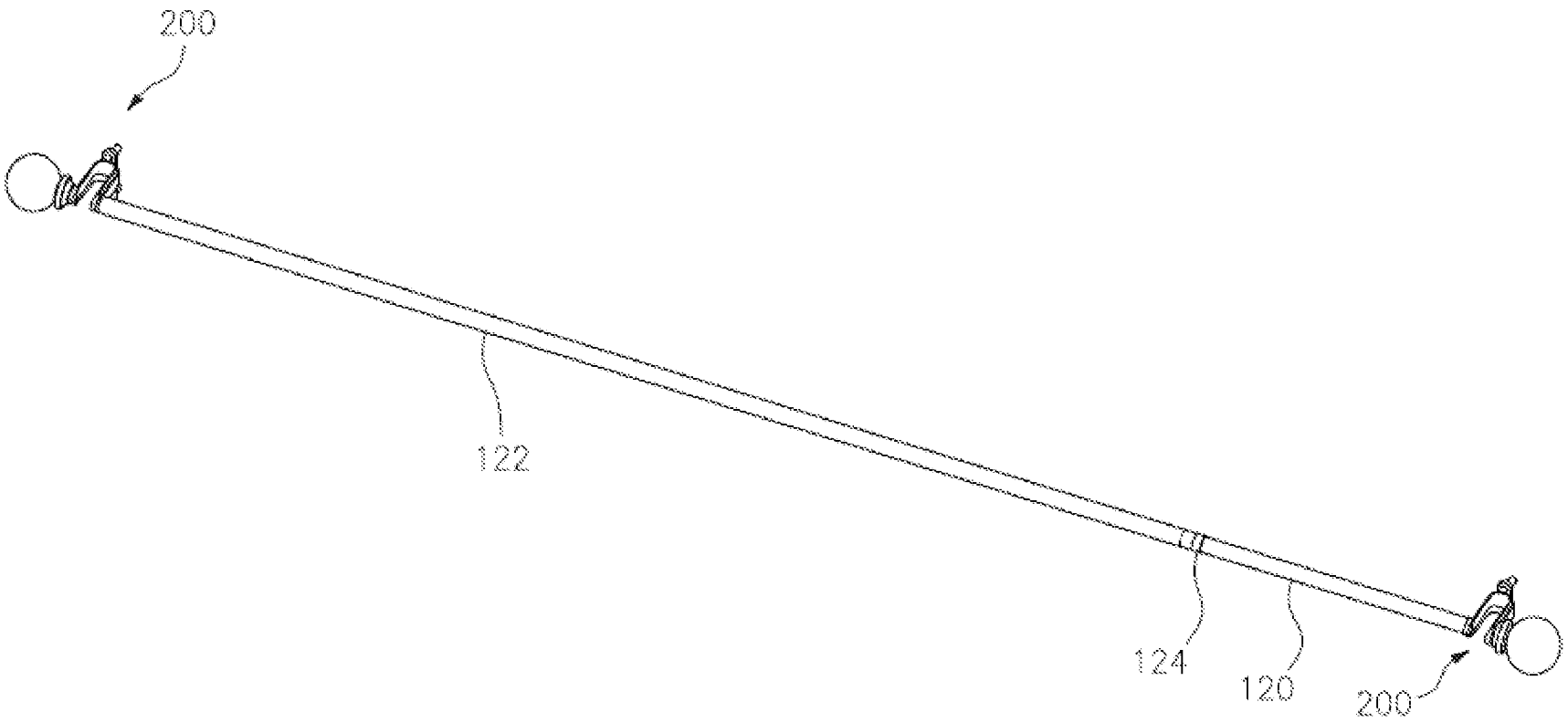
FIG. 3 is a front side isometric view of a curtain rod having a curtain rod return bracket with a decorative finial, in accordance with another embodiment of the invention.
Figure 4:
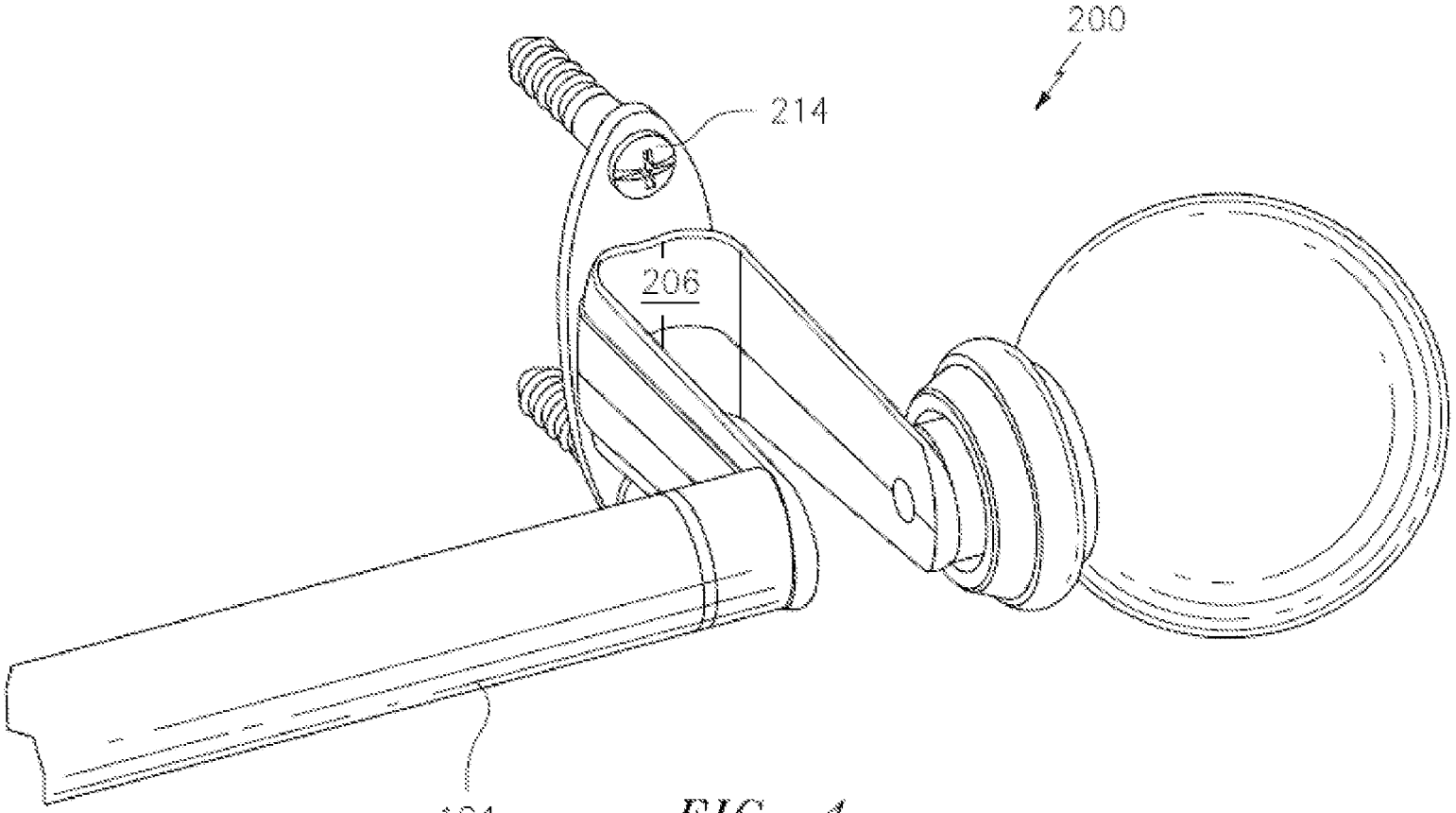
FIG. 4 is a front side perspective view of the curtain rod return bracket having a finial for the curtain rod of FIG. 3.
Figure 5:
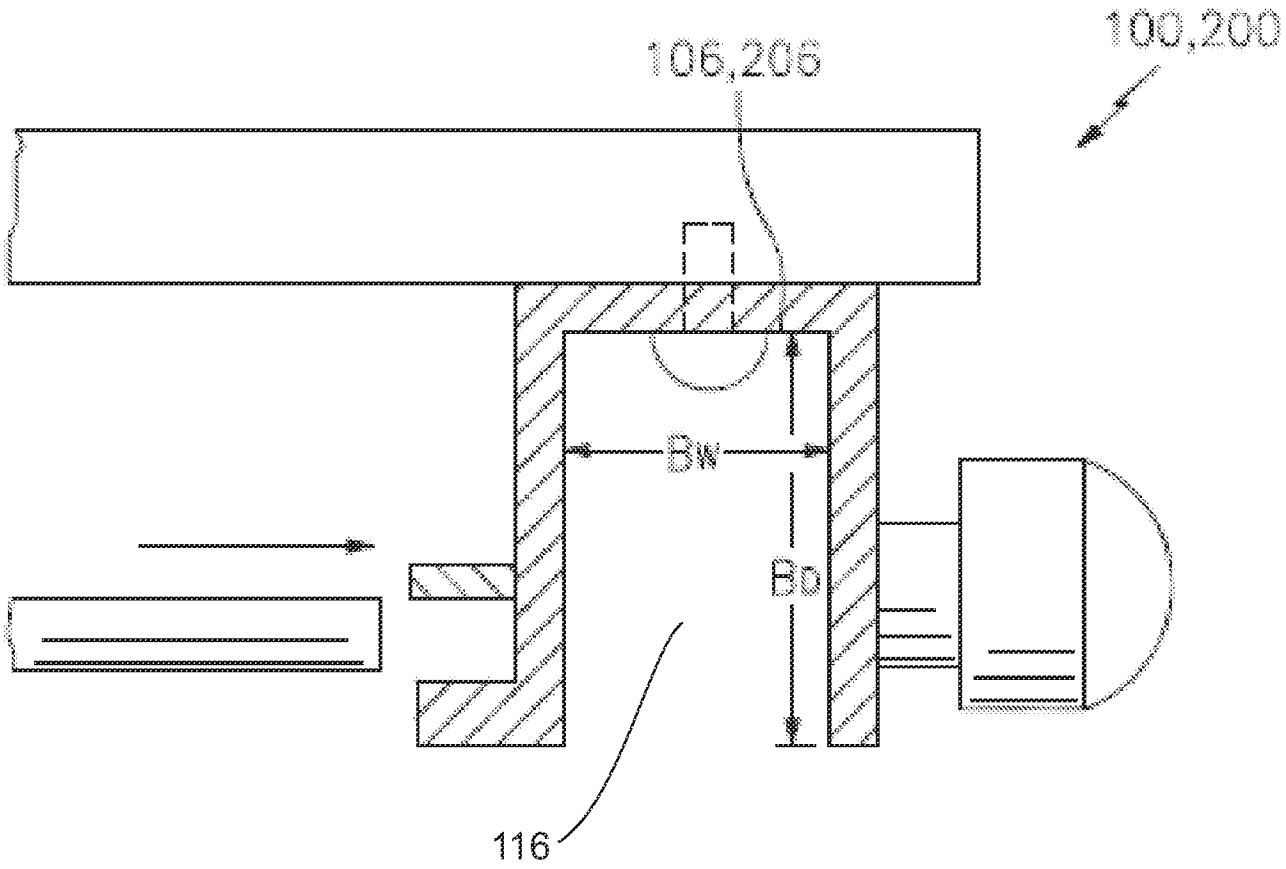
FIG. 5 is a top down sectional view of the curtain rod/curtain rod return bracket combination of FIG. 1 connected to the trim of a window.
Figure 6A:
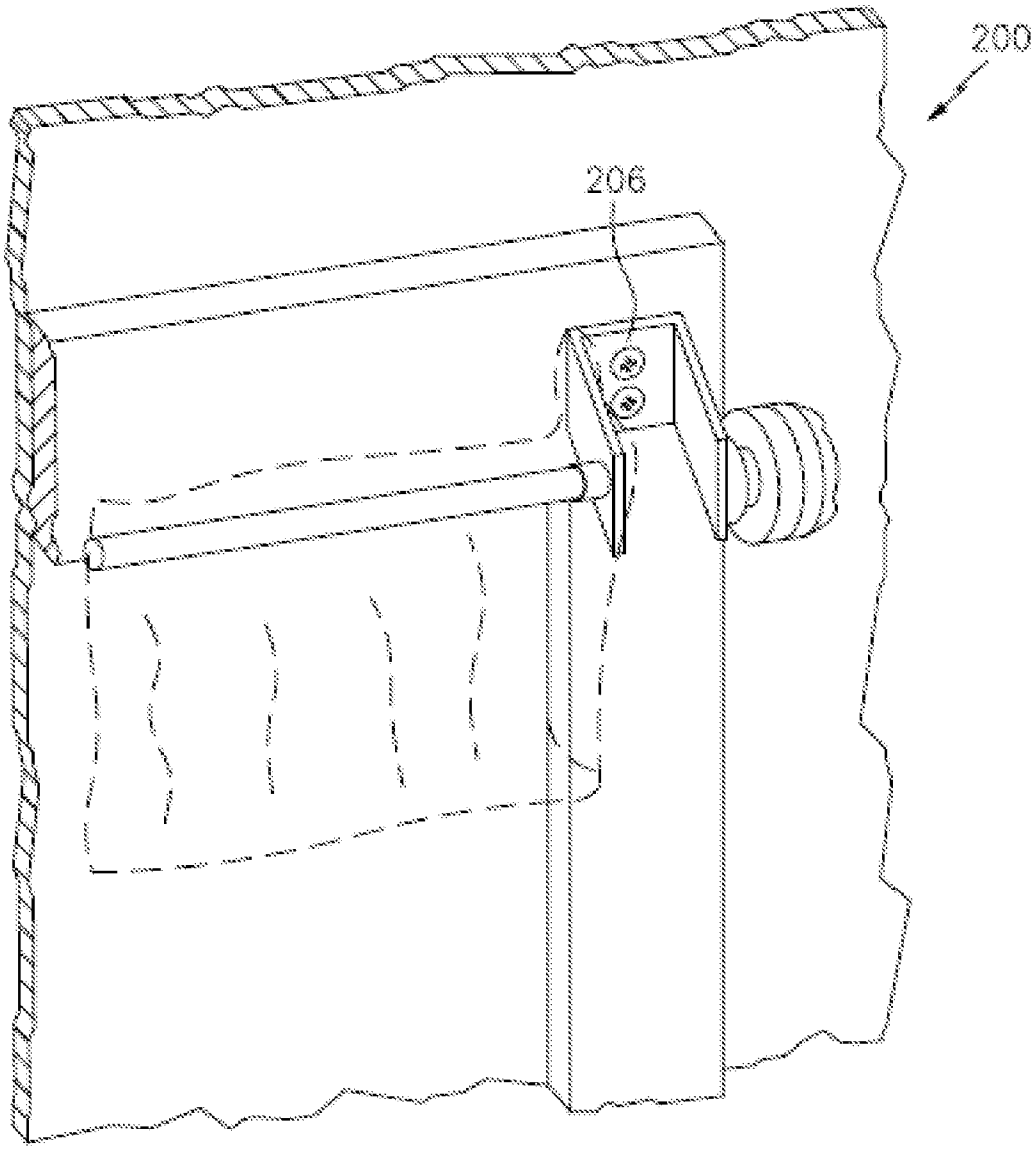
FIG. 6A is a left top side view of a curtain rod connected to the curtain rod return bracket of FIG. 1 connected to the trim of a window.
Figure 6B:
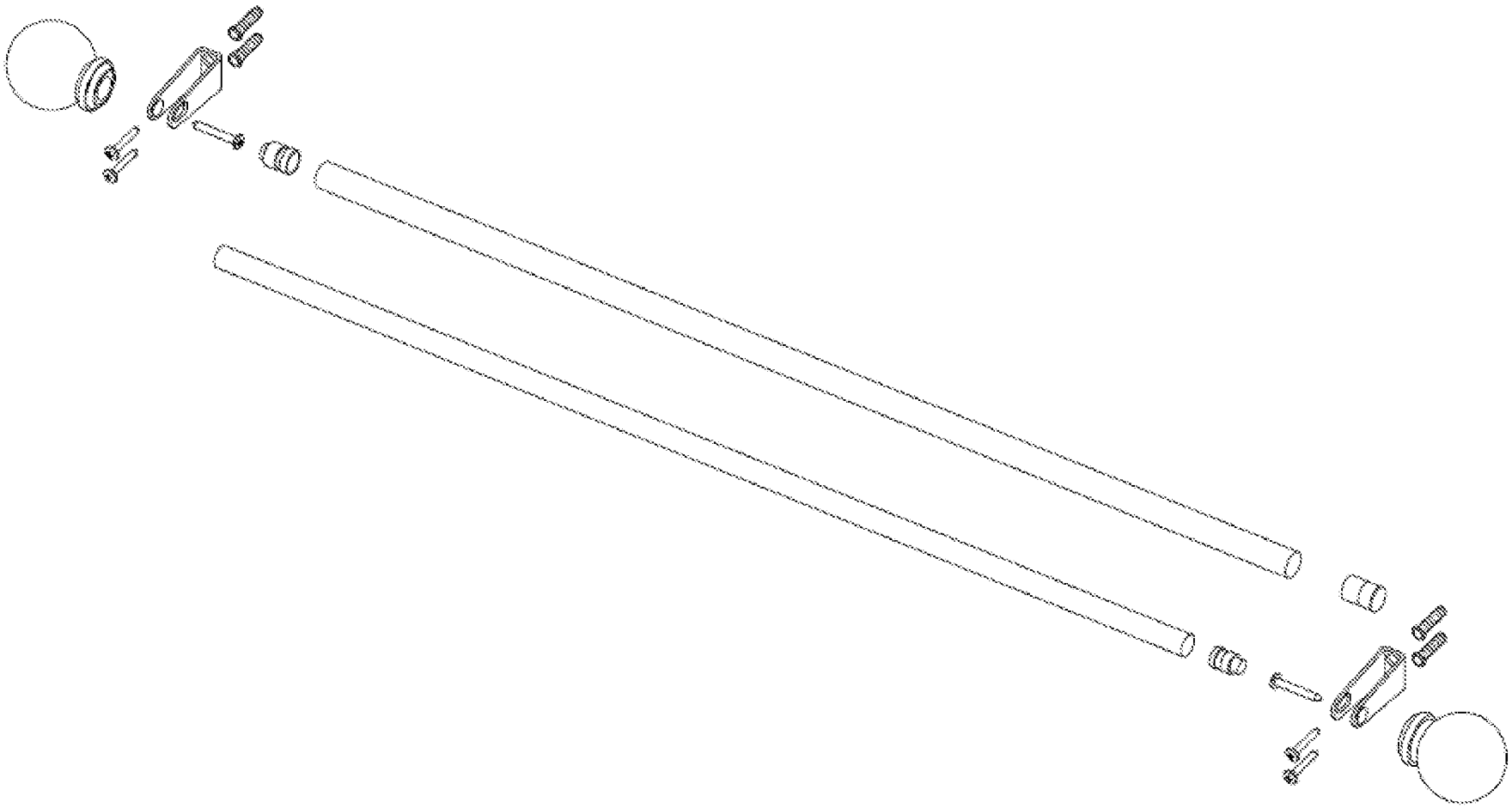
FIG. 6B is a front side exploded view of the curtain rod of FIG. 1.

Referring to FIG. 3 and FIG. 4, a curtain rod return bracket 200 in accordance with an additional embodiment is shown, wherein the bracket center portion 206 includes one or more through cavities 214 by which the return bracket 100 can be securely associated with a wall or window trim via screws or other mounting means. It should be appreciated that the curtain rod return bracket 200 may be securely associated with a wall structure or window trim via any method and/or device suitable to the desired end purpose, such as screws, clips, friction fit and/or adhesive.

Referring again to FIG. 2B, a side view of the inner bracket leg 102 is illustrated and shows the rod attachment article 108, wherein the rod attachment article 108 defines a rod cavity for supportingly containing the end of a curtain rod. Referring again to FIG. 2C, a side view of the outer bracket leg 104 is illustrated and shows the finial attachment article 110, wherein the finial attachment article 110 defines a finial cavity for supportingly containing the end of a finial. Additionally, referring to FIG. 2A, FIG. 5, FIG. 6A and FIG. 6B, the bracket center portion 106 is sized to separate the bracket inner leg 102 from the bracket outer leg 104 via a bracket cavity 116 having a bracket cavity width $B_W$ and a bracket cavity depth $B_D$, wherein the inner bracket leg 102 has an inner bracket leg length that is substantially equal to the bracket cavity depth $B_D$. The inner bracket leg 102 and the bracket cavity width $B_W$ advantageously allows a curtain or drape that is located on the curtain rod to be slipped over the inner bracket leg 102 to cover the side portion of the window opening. Additionally, if a decorative finial is desired then a finial can be associated with the finial cavity of the outer bracket leg 104 via any method or device suitable to the desired end purpose, such as via a friction fit, clip, screw, etc. It should be appreciated that one or both of the bracket inner leg 102 and the bracket outer leg 104 may be movable (for example, slidable) relative to each other to allow the size of the bracket cavity 116 (i.e. bracket cavity width Bw) to be increased or decreased as desired.

Accordingly, the curtain return bracket 100, 200 is implemented by securely attaching a first curtain return bracket 100, 200 to one side of a window (to wall or window trim) such that the inner bracket leg 102 of the first curtain return bracket 100, 200 is located proximate the window. A second curtain return bracket 100, 200 is then securely attached to the other side of the window (to wall or window trim) such that the inner bracket leg 102 of the second curtain return bracket 100, 200 is located proximate the window and such that the inner bracket leg 102 of the first curtain return bracket 100, 200 is aligned with the inner bracket leg 102 of the second curtain return bracket 100, 200. A curtain rod is then associated with a curtain (or drapery) such that the curtain rod is protruding from each end of the curtain. One end of the curtain rod is securely associated with the rod attachment article 108 of the first curtain return bracket 100 and the other end of the curtain rod attachment article 108 is securely associated with the rod attachment article 108 of the second curtain return bracket 100, 200. One end of the curtain is adjusted by sliding the curtain over the inner bracket leg 102 of the first curtain return bracket 100, 200 and the other end of the curtain is adjusted by sliding the curtain over the inner bracket leg 102 of the second curtain return bracket 100, 200. It should be appreciated that one or two (or more) curtains may be located on the curtain rod such that the sides of the curtains will block the light from the side of the window and the center of the curtains may be drawn together to cover the front of the window opening. It should be appreciated that if curtain/drape rings are used, then the curtain/drape rings will slide over and be located over the inner bracket leg 102 of the second curtain return bracket 100, 200 such that the curtain/drape will block/limit light from entering through the side of the window.

Referring to FIG. 6, an additional embodiment of the curtain return bracket 200 is shown and is configured to operate with a flat curtain rod. In this embodiment, the curtain return bracket 200 may include an inner bracket leg 202 and an outer bracket leg 204, wherein the end of the flat curtain rod may slide over the inner bracket leg 202 or the flat curtain rod may attach to the inner bracket leg 202 via any other article or method suitable to the desired end purpose, such as a clip, screw, notched portion, etc . . . . As above, a finial may be securely associated with the outer bracket leg 204.

Figure 7:
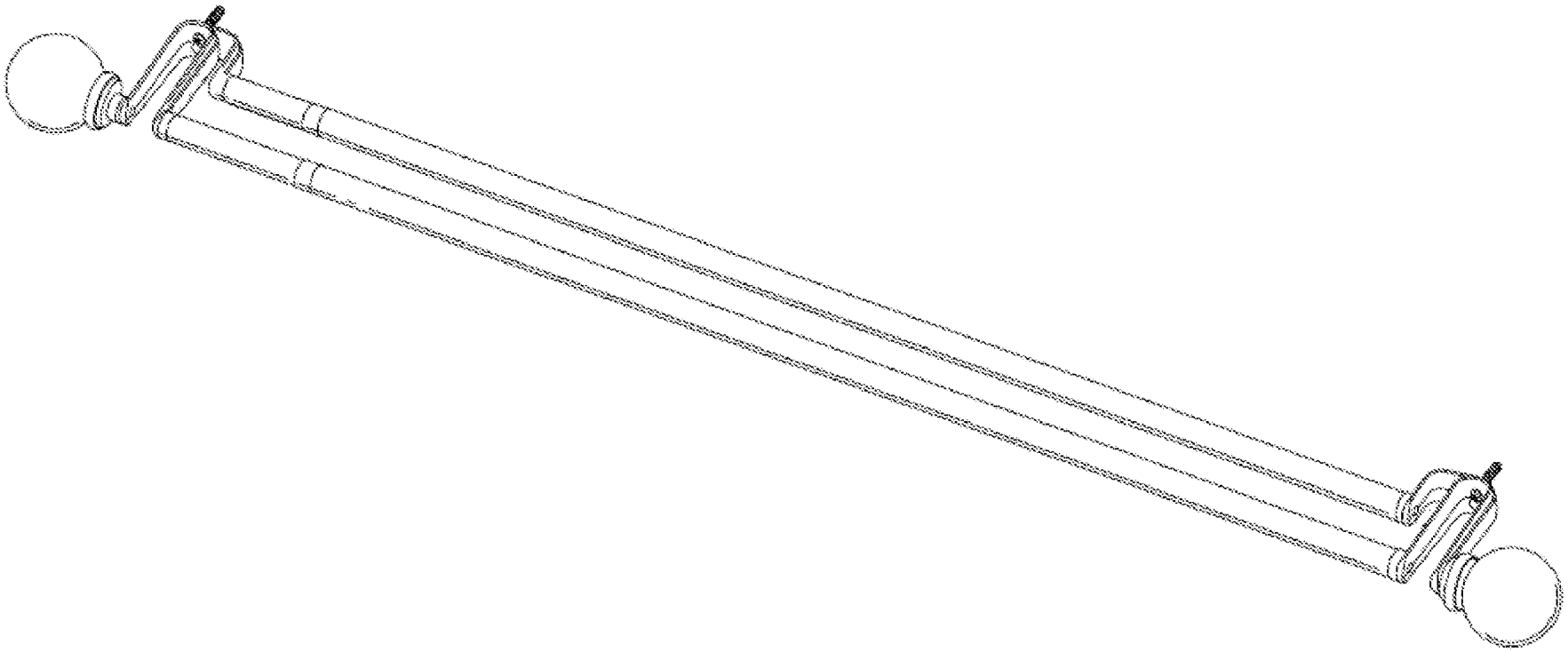
FIG. 7 is a front side isometric view of a curtain rod having a double curtain rod return bracket with a decorative finial, in accordance with yet another embodiment of the invention.
Figure 8:
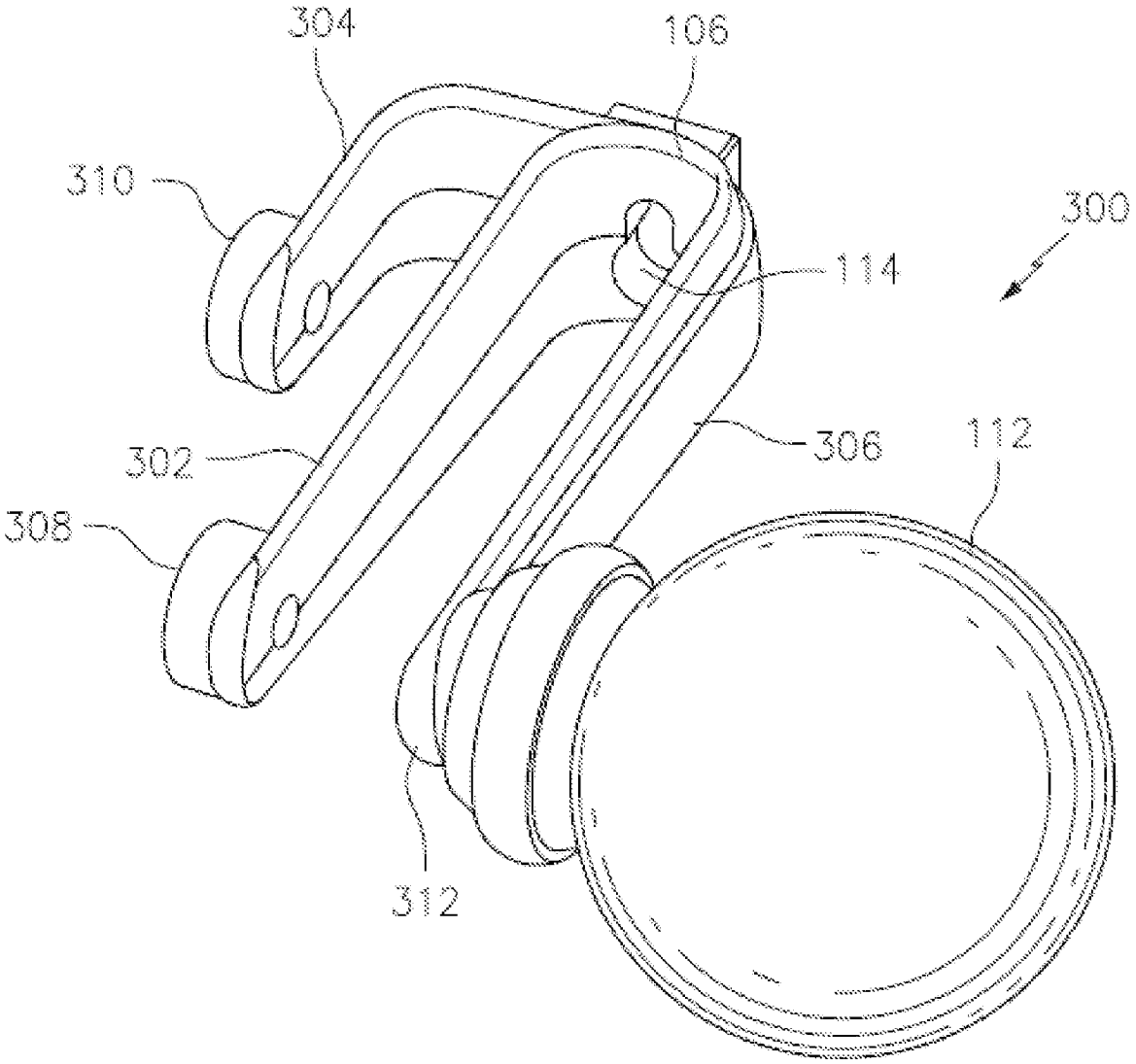
FIG. 8 is a front side perspective view of the double curtain rod return bracket having a finial for the curtain rod of FIG. 5.
Figure 9:
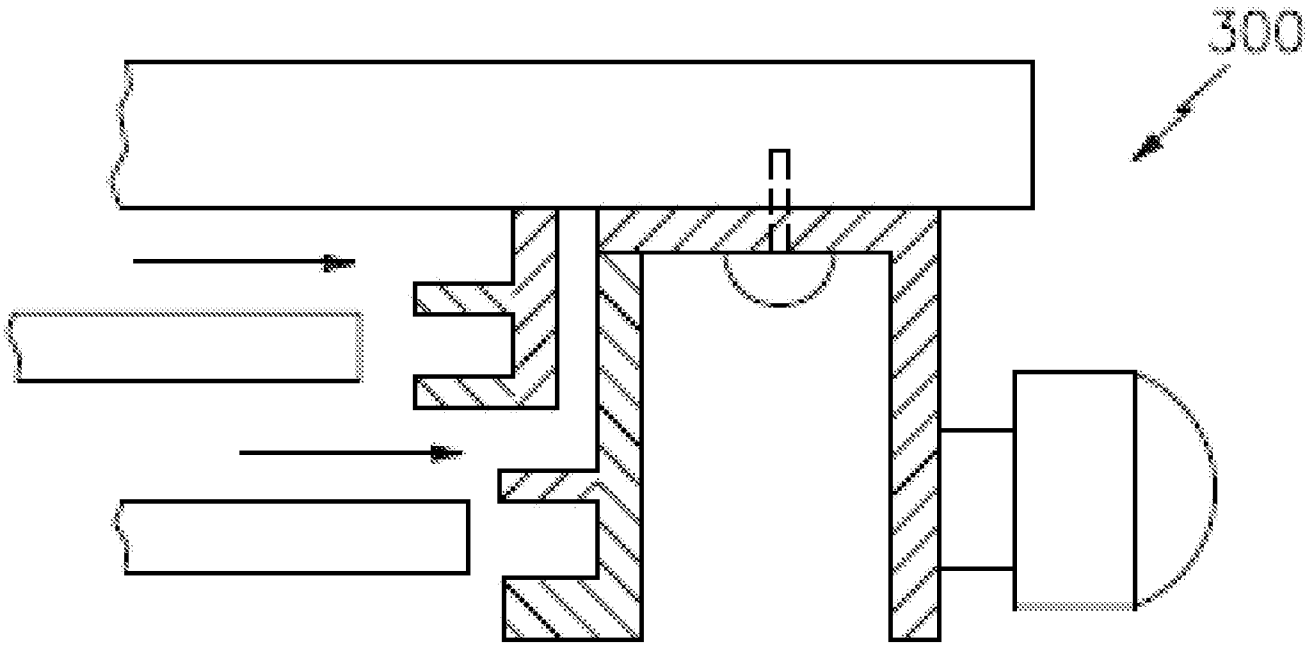
FIG. 9 is a top down sectional view of the curtain rod/curtain rod return bracket combination of FIG. 8 connected to the trim of a window.

Referring to FIG. 7, FIG. 8 and FIG. 9, a double curtain rod return bracket 300 in accordance with still yet another embodiment is illustrated, wherein the double curtain rod return bracket 300 includes a first inner bracket leg 302, a second inner bracket leg 304 and an outer bracket leg 306. The first inner bracket leg 302 includes a first curtain rod attachment article 308 for securely associating with a first curtain rod and the second inner bracket leg 304 includes a second rod attachment article 310 for securely associating with a second curtain rod. This configuration advantageously allows for a window treatment having more than one curtain/drape. When two curtains/drapes are used, typically a heavier curtain/drape is associated with the first curtain rod and a lighter more sheer curtain is associated with the second curtain rod. It should be appreciated that both of the first and second inner bracket legs 302, 304 allow the curtain/drape to be located over (or the curtain rings may be located over) the first and second inner bracket legs 302, 304 such that the curtain/drape can block/limit light coming in from the side of the window. Additionally, the outer bracket leg 306 further includes a finial attachment article 312 configured to securely associate with and support a decorative article, such as a finial 112.

Figure 10:
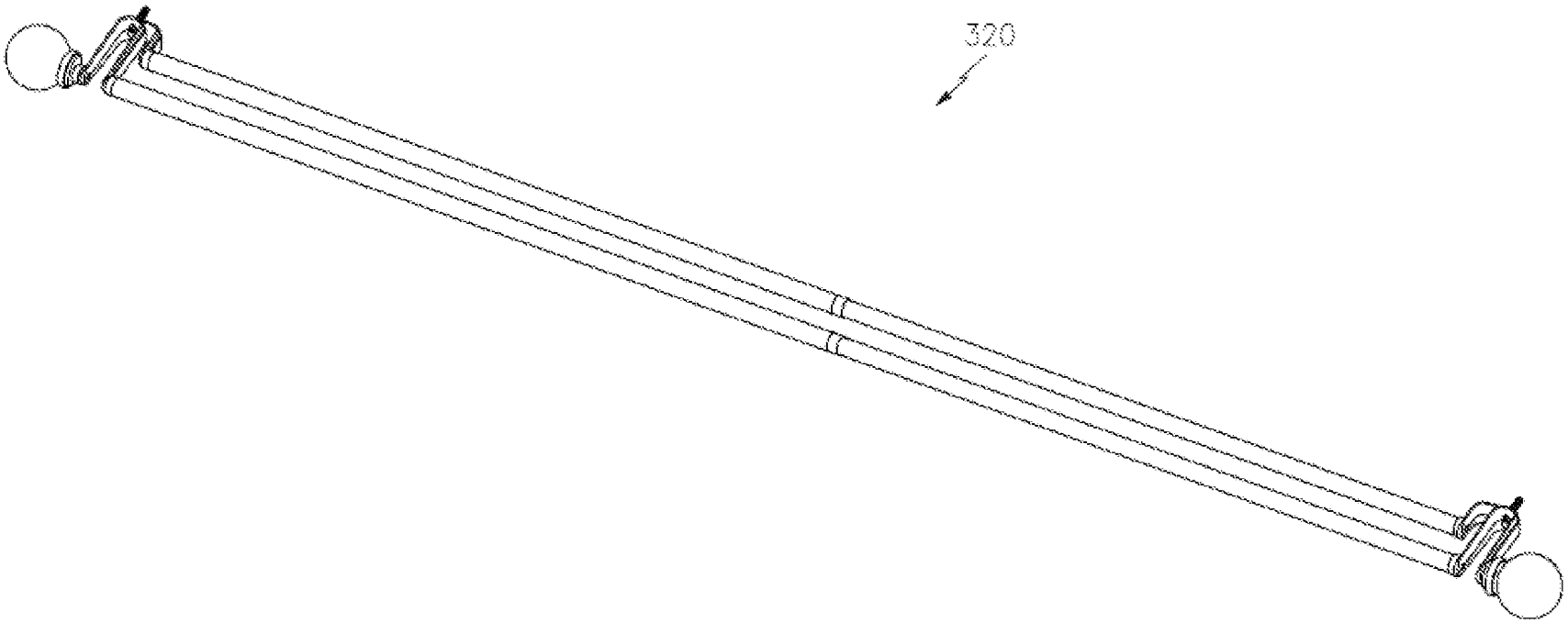
FIG. 10 is a front side isometric view of a curtain rod having a double curtain rod return bracket with a decorative finial, in accordance with still yet another embodiment of the invention.
Figure 11:
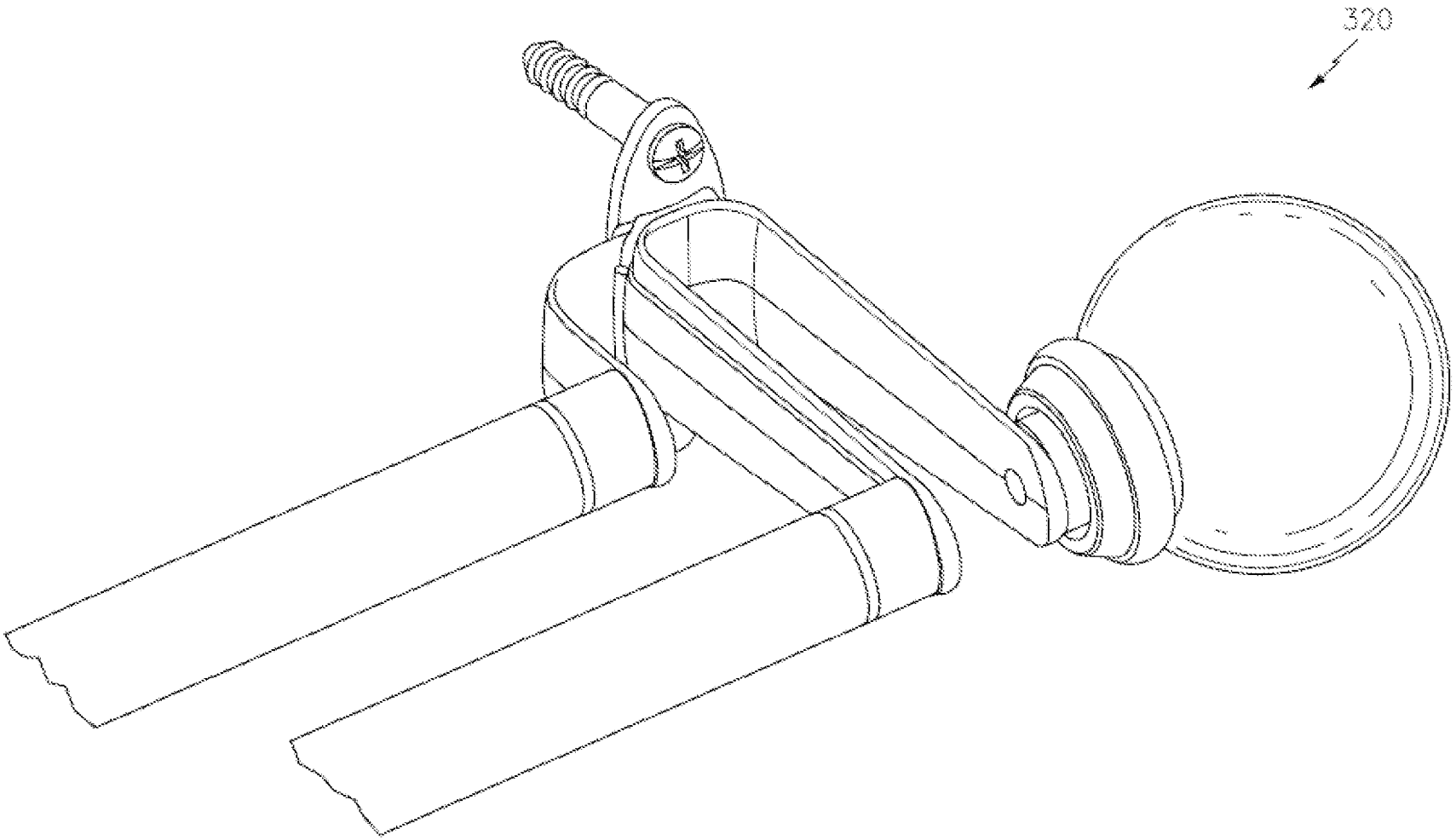
FIG. 11 is a front side perspective view of the double curtain rod return bracket of the curtain rod of FIG. 10.

Referring to FIG. 10 and FIG. 11, another embodiment of the double curtain rod return bracket 320 is shown, wherein the mounting through cavities 114 located on the bracket center portion 106 are shown in another configuration.

Figure 12:
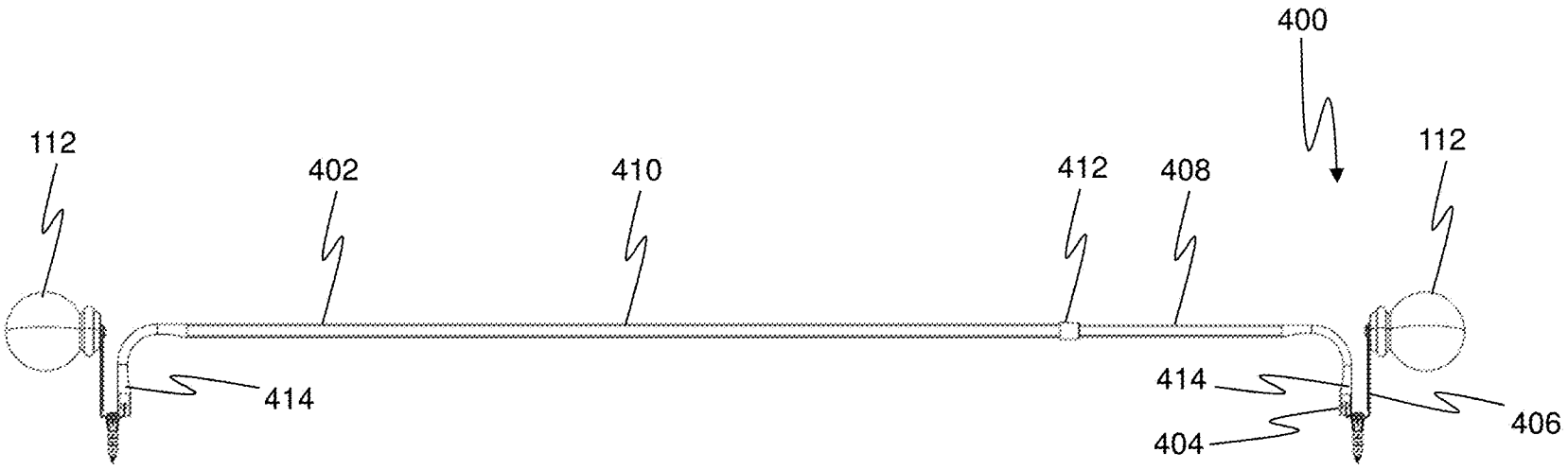
FIG. 12 is a front side perspective view of a curtain rod return bracket configured for use with a flat curtain rod, in accordance with an additional embodiment.
Figure 13:
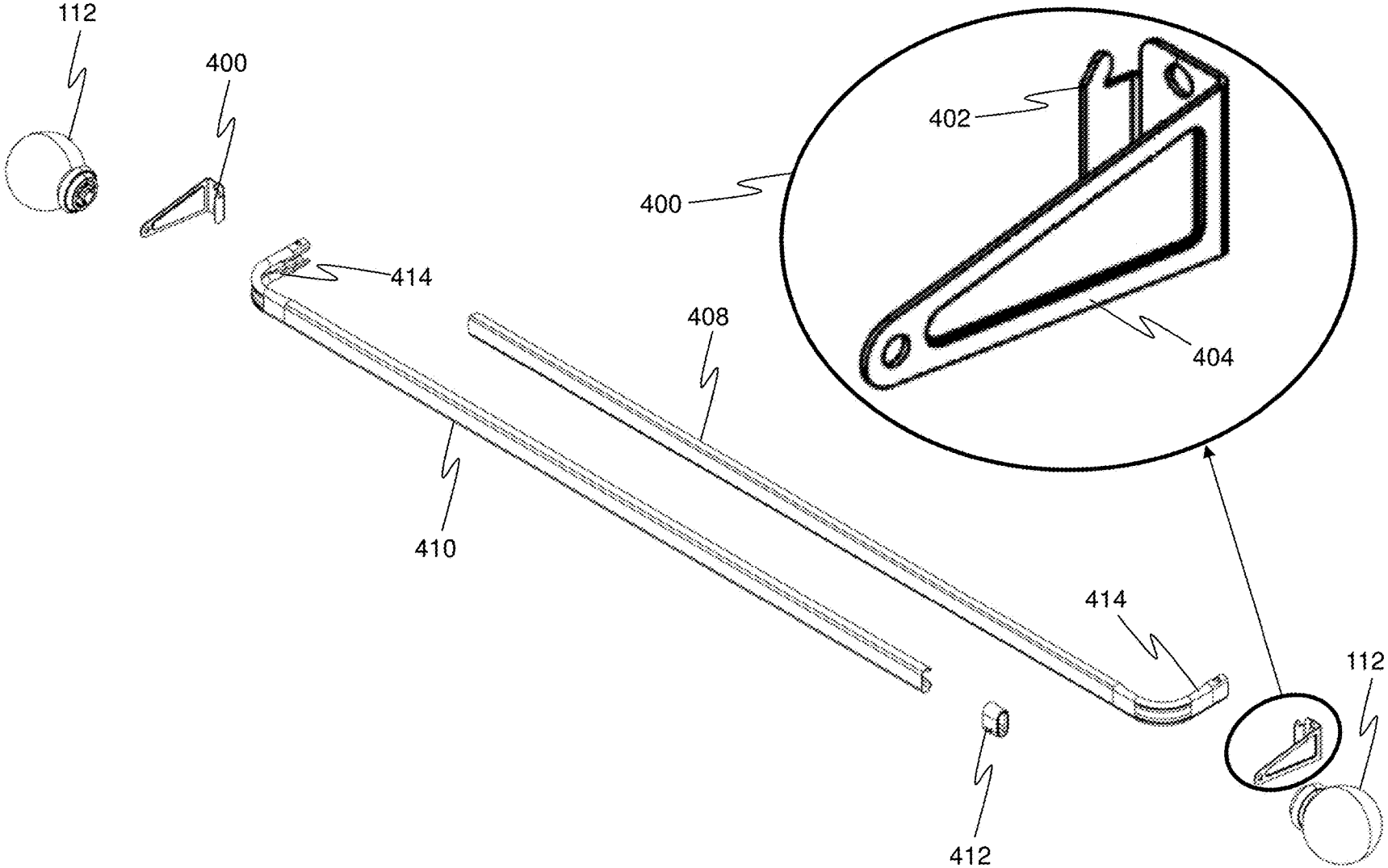
FIG. 13 is a front side exploded view of the curtain rod return bracket of FIG. 12.
Figure 14:
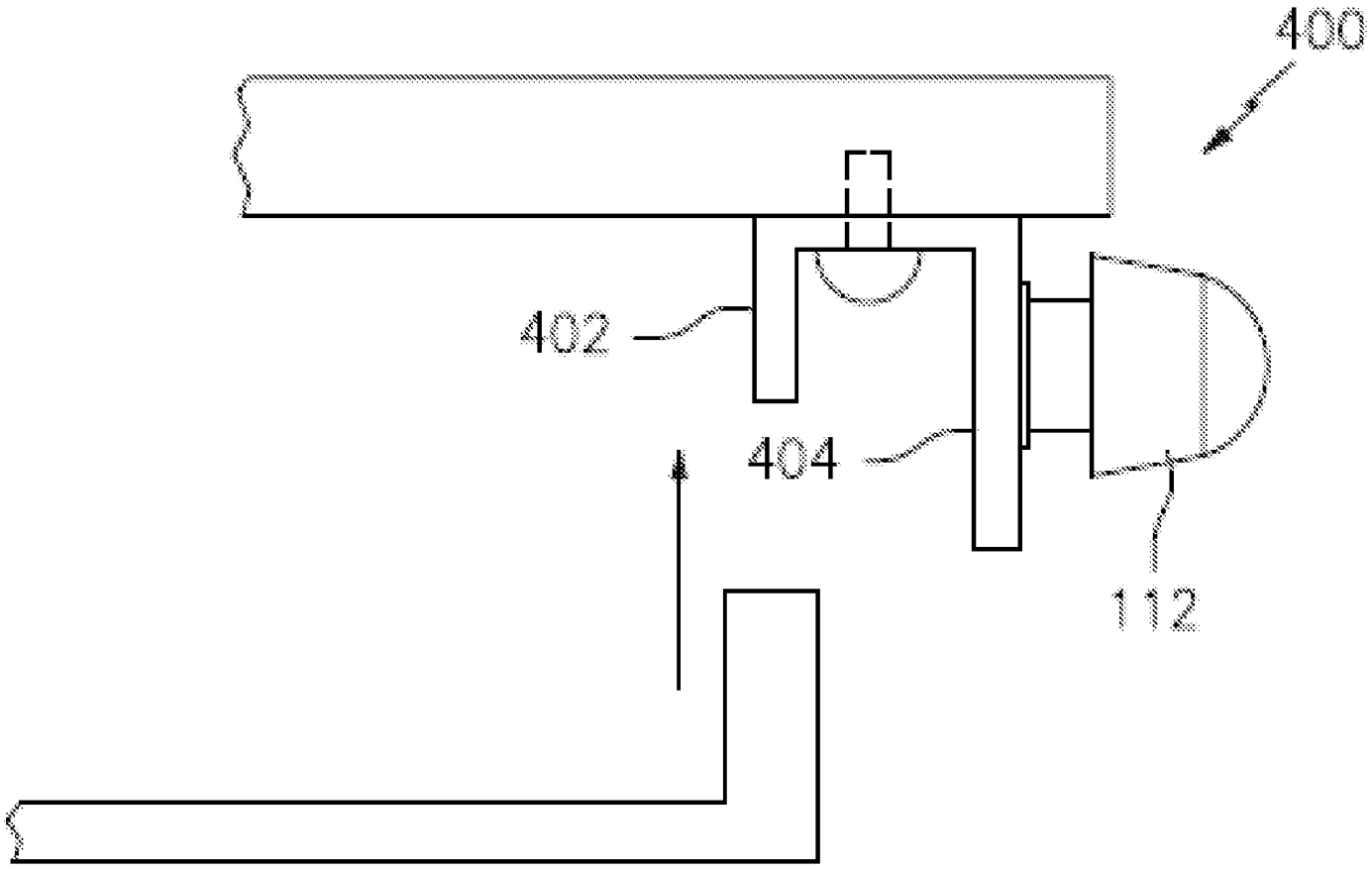
FIG. 14 is a top down view of the curtain rod return bracket of FIG. 12 configured for use with a flat curtain rod in accordance with an additional embodiment, showing a flat curtain rod being associated with the curtain return bracket.

Referring to FIG. 12, FIG. 13 and FIG. 14, still yet another embodiment of the curtain return bracket 400 is shown and is configured to operate with a flat curtain rod 402. In this embodiment, the curtain return bracket 400 may include an inner bracket leg 404 and an outer bracket leg 406. Additionally, the flat curtain rod 402 may include an inner rod 408, an outer rod 410 and a sleeve 412, wherein the inner rod 408 is sized to slide within the outer rod 410 in a telescoping manner and wherein the sleeve 412 acts as an interface between the inner rod 408 and the outer rod 410. It should be appreciated that one end of the inner rod 408 and the outer rod 410 is a mounting end 414 and is configured to be substantially perpendicular (any angle between 0° and 90° is contemplated) to the mounting surface and thus includes a bend. This advantageously allows the mounting end 414 of the inner rod 120 and the outer rod 122 to securely interact with the inner bracket leg 404, wherein the end of the flat curtain rod may slide over the mounting end 414 and the inner bracket leg 402. It should be appreciated that the flat curtain rod may attach to the inner bracket leg 402 via any other article and/or method suitable to the desired end purpose, such as a clip, screw, notched portion, etc. As discussed hereinabove, a finial 112 may be securely associated with the outer bracket leg 204, via any device and/or method suitable to the desired end purpose, such as a screw, bolt, clip, etc.

Figure 15:
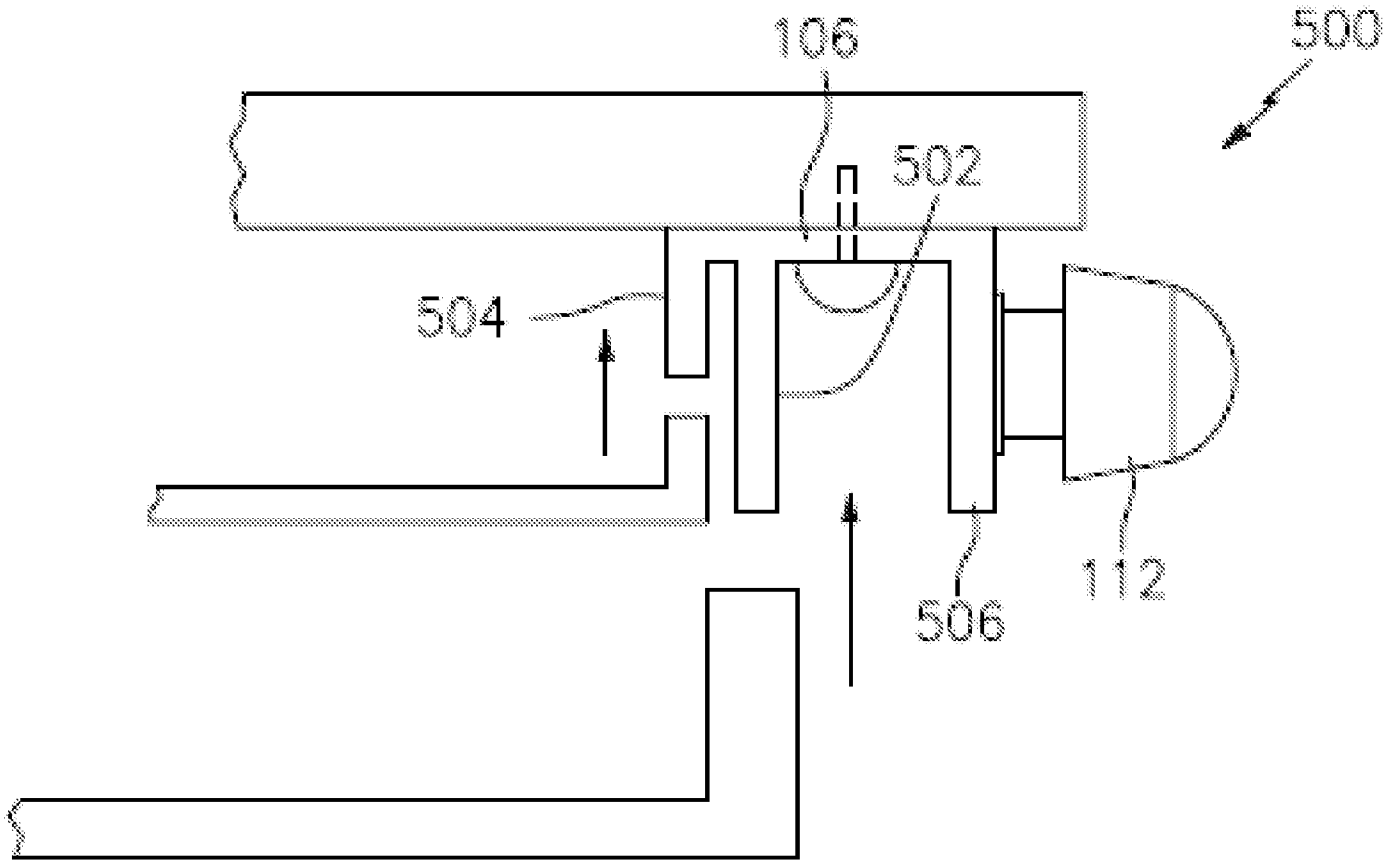
FIG. 15 is a top down view of a double curtain rod return bracket configured for use with two flat curtain rods in accordance with an additional embodiment, showing two flat curtain rods being associated with the curtain return bracket.

Referring to FIG. 15, still yet another embodiment of the curtain return bracket 500 is shown and is configured to operate with a flat curtain rod. In this embodiment, the curtain return bracket 500 includes a first inner bracket leg 502, a second inner bracket leg 504 and an outer bracket leg 506. As with the second embodiment, the end of the flat curtain rods attach to the first inner bracket leg 502 and second inner bracket leg 504 via any other article or method suitable to the desired end purpose, such as a clip, screw, notched portion, etc. As with the other embodiments, the curtains associated with the first and second inner bracket legs 502, 504 may slide over and cover (or the curtain rings may cover) the first and second inner bracket legs 502, 504. This blocks/limits light from entering via the side of the window.

Figure 16:
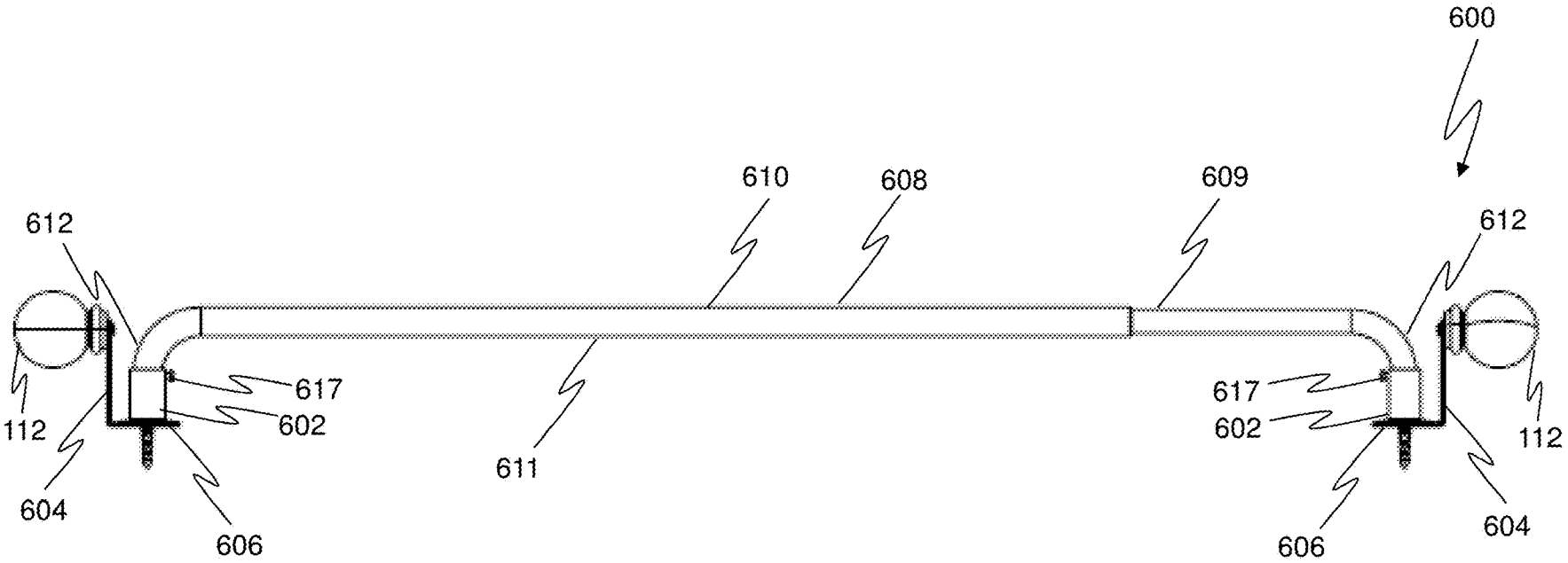
FIG. 16 is a top down view of a curtain rod return bracket for use with a cylindrical curtain rod, in accordance with still yet another embodiment.
Figure 17:
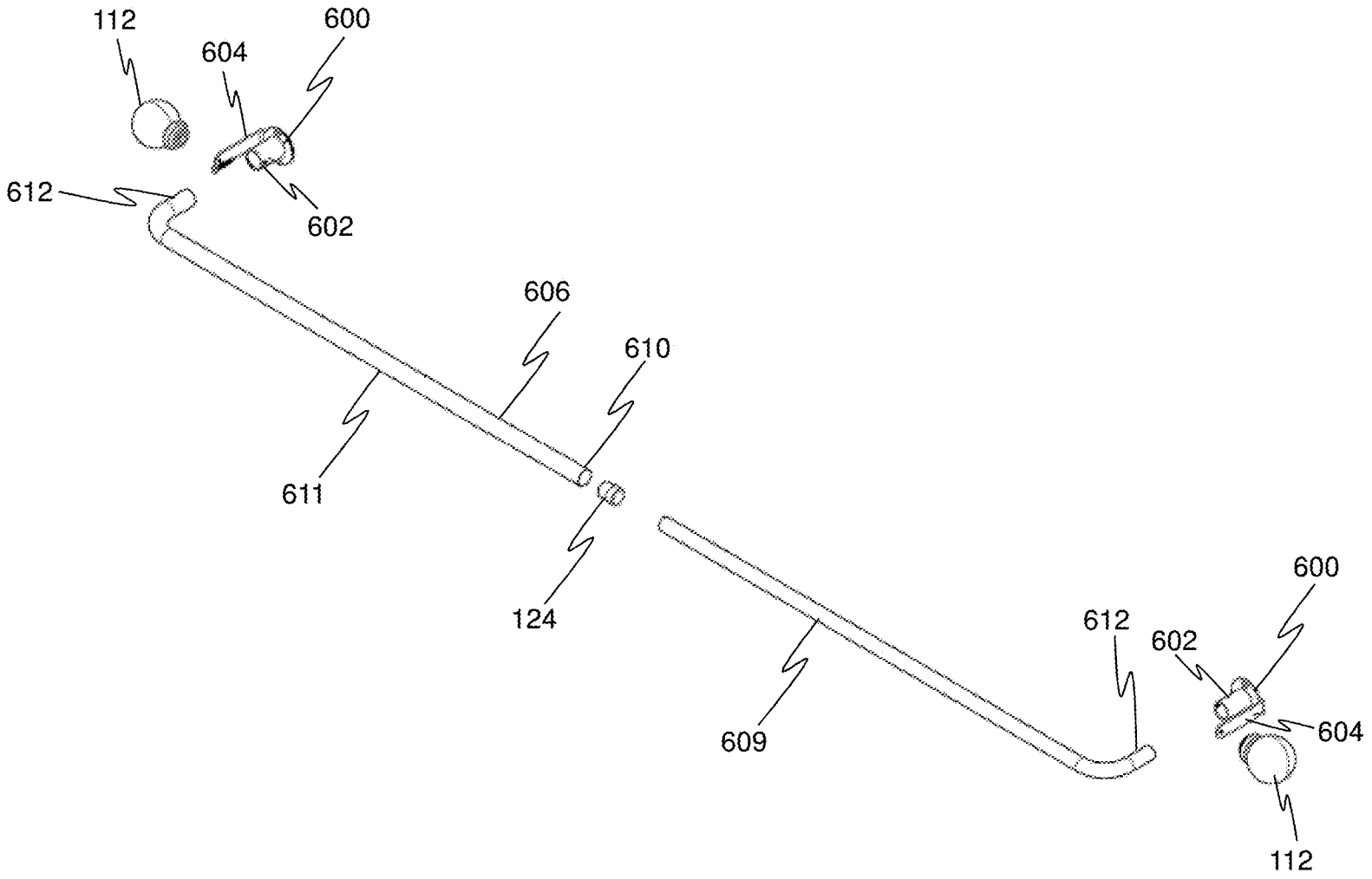
FIG. 17 is a top down side exploded view of the cylindrical curtain rod return bracket/curtain rod combination of FIG. 16.
Figure 18:
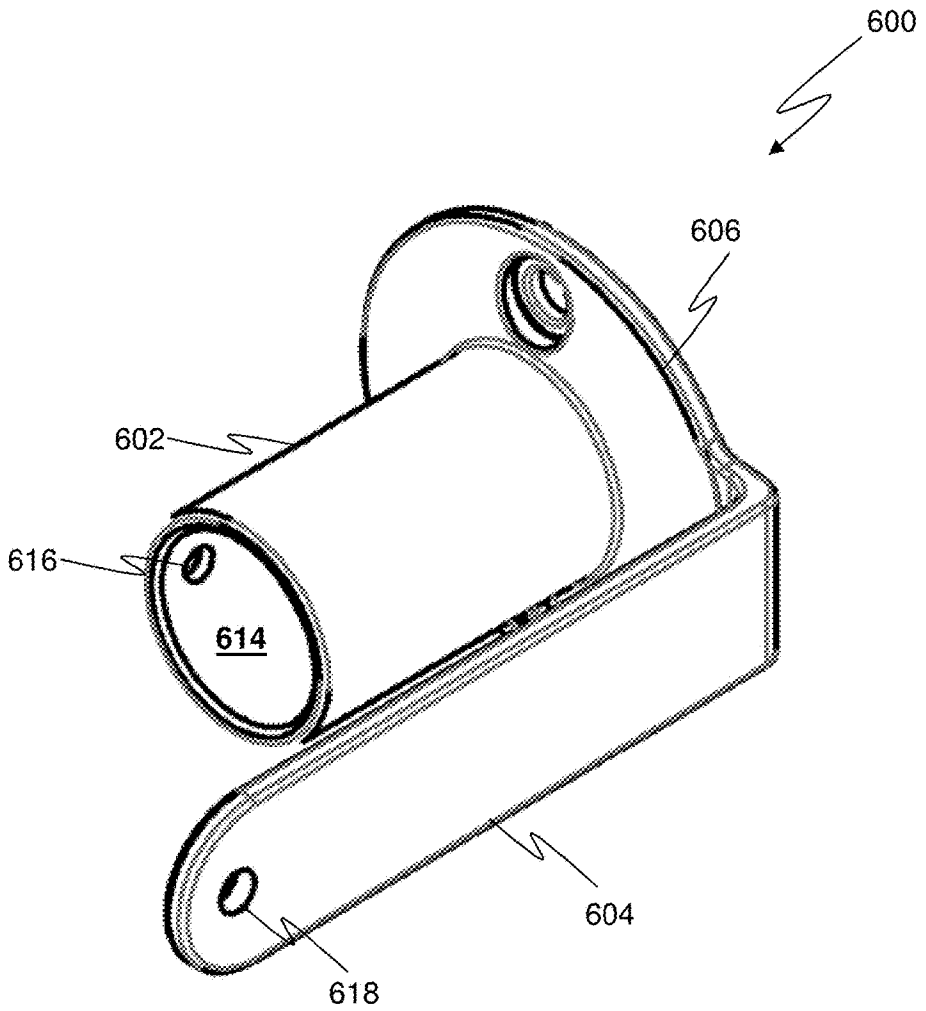
FIG. 18 is a front side isometric view of the curtain rod return bracket of FIG. 16 for use with a cylindrical curtain rod.

Referring to FIG. 16, FIG. 17 and FIG. 18, still yet another embodiment a curtain rod return bracket 600 is shown and is configured to operate with a cylindrical curtain rod 608. In this embodiment, the curtain return bracket 600 includes an inner bracket leg 602, an outer bracket leg 604 and a bracket mounting portion 606. Additionally, the curtain rod 608 may include an inner rod 609, an outer rod 611 and a sleeve 124, wherein the inner rod 609 is sized to slide within the outer rod 611 in a telescoping manner and wherein the sleeve 124 acts as an interface between the inner rod 609 and the outer rod 611. The curtain rod 608 also includes a curtain rod middle portion 610 and each of the inner rod 609 and the outer rod 611 include a curtain rod end 612 that is angled to be substantially perpendicular (any angle from 0° to 90° may be used) to the curtain rod middle portion 610. It should be appreciated that the first inner bracket leg 602 defines a bracket cavity 614 which is sized and shaped to contain the curtain rod ends 612. Additionally, the first inner bracket leg 602 may define a rod mounting opening 616 (which may or may not be threaded as desired) communicated with the bracket cavity 614 to allow a securing screw 617 to compress against the side wall of the curtain rod 608 when the curtain rod 608 is located within the bracket cavity 614. This advantageously anchors the curtain rod 608 within the bracket cavity 614. Moreover, the outer bracket leg 604 may define a finial mounting opening 618 (which may or may not be threaded as desired) to allow a securing screw to securingly associate a finial 112 with the curtain rod return bracket 600. Additionally, the bracket mounting portion 606 may define one or more mounting holes 620 for using a screw (or nail) to mount the curtain rod return bracket 600 to a wall or window trim.

It should be appreciated that the curtain return bracket 100, 200, 300, 400, 500, 600 may be constructed from any material suitable to the desired end purpose, such as metal, wood, plastic, composite or any combination of thereof.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

We claim:

1. A curtain rod return bracket, comprising:

a center portion that is configured to be mounted to a surface of a window or a wall proximate the window;

an inner leg extending from the center portion and comprising a rod attachment article that is configured to support a curtain rod and positioned proximate a first end of the inner leg, wherein the rod attachment article is spaced from the center portion by a first distance;

an outer leg extending from the center portion and comprising a finial attachment article having a screw, bolt or clip to secure and support a decorative finial that is separate from the curtain rod, wherein the finial attachment article is spaced from the center portion by the first distance and is positioned proximate a second end of the outer leg;

wherein the center portion is configured to separate the inner leg from the outer leg via a bracket cavity having a bracket cavity width between the inner and outer legs;

wherein the bracket cavity includes an opening extending from the first end of the inner leg to the second end of the outer leg, the opening having a width equal to the width of the bracket cavity proximate the center portion; and wherein the rod attachment article and the finial attachment article are aligned along a rod-finial axis such that when the curtain rod is supported by the rod attachment article and the finial is supported by the finial attachment article the rod and finial are aligned along the rod-finial axis, with neither of the rod and finial extending into the bracket cavity.

2. The curtain rod return bracket of claim 1, further comprising a second bracket inner leg that is substantially parallel to the inner leg.

3. The curtain rod return bracket of claim 1, wherein the center portion defines at least one through cavity configured to contain a mounting screw.

4. The curtain rod return bracket of claim 1 wherein the curtain rod includes an inner rod and an outer rod.

5. The curtain rod return bracket of claim 4, wherein the curtain rod is cylindrical and wherein the inner rod includes an inner rod diameter and the outer rod includes an outer rod diameter.

6. The curtain rod return bracket of claim 5, wherein the outer rod diameter is larger than the inner rod diameter.

7. The curtain rod return bracket of claim 4, wherein the curtain rod is a flat rod and wherein the inner rod includes an inner rod width and the outer rod includes an outer rod width.

8. The curtain rod return bracket of claim 7, wherein the outer rod width is larger than the inner rod width.

9. The curtain rod return bracket of claim 1, wherein the inner and outer legs are substantially perpendicular to the rod.

10. The curtain rod return bracket of claim 1, wherein the rod attachment article defines a rod cavity that is configured to contain an end of the rod.

11. The curtain rod return bracket of claim 2, wherein the second bracket inner leg comprises a second rod attachment article for securely associating with a second curtain rod.

12. The curtain rod return bracket of claim 11, wherein the second rod attachment article is spaced from the center portion by a second distance that is less than the first distance.

* * * * *